US006123033A

United States Patent [19]

Polley et al.

[11] Patent Number: 6,123,033

[45] **Date of Patent: *Sep. 26, 2000**

[54] SHELVING SYSTEM

[75] Inventors: Christopher R. J. Polley, Ventura, Calif.; Todd W. Jacobson, Seattle, Wash.

[73] Assignees: Patagonia, Inc., Ventura, Calif.; Utility, Inc., Seattle, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 09/225,929

[22] Filed: Jan. 5, 1999

[51] Int. Cl.[7] ..... A47B 9/00

[52] U.S. Cl. ..... 108/107; 108/110; 108/180; 211/90.02; 211/186; 248/235; 248/250

[58] Field of Search ..... 108/99, 107, 106, 108/110, 147.11, 147.17, 144.11, 180, 152, 8, 15, 157.18; 211/90.02, 90.04, 99, 186, 150; 248/242, 241, 250, 235

[56] References Cited

U.S. PATENT DOCUMENTS

| | | | |
|---|---|---|---|
| 2,169,752 | 8/1939 | Wright | 108/15 |
| 2,915,196 | 12/1959 | Pira | 108/109 |
| 3,081,972 | 3/1963 | Gray, Jr. | 108/106 |
| 3,151,576 | 10/1964 | Patterson . | |
| 3,295,471 | 1/1967 | Cook | 108/163 |
| 3,921,539 | 11/1975 | Berger | 108/106 X |
| 4,159,814 | 7/1979 | Fibus | 108/110 X |
| 4,314,685 | 2/1982 | Schwan | 108/107 X |
| 4,408,812 | 10/1983 | Krautwurst | 108/107 X |
| 4,696,406 | 9/1987 | Karashima | 108/110 X |
| 4,858,773 | 8/1989 | Zimmerman . | |
| 5,174,200 | 12/1992 | Jeandel et al. | 108/107 X |
| 5,460,345 | 10/1995 | Trevaskis . | |
| 5,502,929 | 4/1996 | Daniels . | |
| 5,605,238 | 2/1997 | Jacobs | 108/180 X |
| 5,749,480 | 5/1998 | Wood | 211/99 X |

*Primary Examiner*—Peter M. Cuomo
*Assistant Examiner*—Hanh V. Tran
*Attorney, Agent, or Firm*—Blakely, Sokoloff, Taylor & Zafman

[57] ABSTRACT

According to one aspect the invention a shelving system is provided comprising first and second vertically extending support structures, and a first set of shelving assemblies. The first and second vertically extending support structures are horizontally spaced from one another and the shelving assemblies are mounted above one another between the support structures. Each shelving assembly has at least one major surface and is locatable respectively in a first orientation, and a second orientation. In the first orientation the major surface remains substantially horizontal. In the second orientation the major surface is substantially vertical.

20 Claims, 5 Drawing Sheets

SHELVING SYSTEM

BACKGROUND OF THE INVENTION

1). Field of the Invention

This invention relates to a shelving system of the kind which may be used for display of articles in commerce.

2). Discussion of Related Art

A shelving system commonly used in retail stores usually comprises a support structure and a number of shelves which are mounted above one another to the support structure. Objects may be located for display on the shelves.

What may be useful is a shelving system which allows for display of objects in a manner which is more interesting than with conventional shelving systems. It may, for example, be useful that shelves of a shelving system be locatable in various orientations, which would allow for the display of certain commercial information on them or for hanging objects from them.

It may also be useful for some of the shelves of the shelving system to be easily removable, or that other shelves allow for suspension of articles such as clothing hangers or baskets from them.

SUMMARY OF THE INVENTION

According to one aspect the invention a shelving system is provided comprising first and second vertically extending support structures, and a first set of shelving assemblies. The first and second vertically extending support structures are horizontally spaced from one another and the shelving assemblies are mounted above one another between the support structures. Each shelving assembly has at least one major surface and is locatable respectively in a first orientation, and a second orientation. In the first orientation the major surface remains substantially horizontal. In the second orientation the major surface is substantially vertical.

The shelving assembly preferably rotates between the first and second orientations about an axis which is substantially located below a center line of the major surface when the shelving assembly is in the first orientation.

The shelving assembly may comprise a planar shelf and two mounting components, secured to the shelf and extending from opposing ends of the shelf. Each mounting assembly may be mounted to a respective support structure while still allowing for movement of the shelving assembly between the first and second orientations.

Preferably, at least the first support structure comprises a vertically extending member and a plurality of channel-shaped members securable at spaced locations to the vertically extending member. At least one of the mounting components of each shelf may be insertable through an upper, open side of a respective channel-shaped member and may rest within the channel-shaped member.

At least one of the shelving assemblies may be movable between the first and second orientations thereof while another of the shelving assemblies remains stationary.

The shelving system preferably further comprises a wall securable member and first link. The first link has one end which is securable to the first support structure and another, opposing end which is secured to the wall securable member.

Each support structure preferably comprises a vertically extending member, and a foot component which is secured to a lower end of the vertically extending member. The foot component may have a lower, floor engaging surface which is adjustable towards or away from the vertically extending member. The foot component may be rotatable and rotation of the foot component may result in adjustment of the lower surface towards or away from the vertically extending member.

The shelving assembly may comprise a planar shelf having the major surface, and a rail secured to the shelf. The rail may have a section, on a side of the shelf opposing the major surface, which is spaced from the shelf. The rail may be substantially horizontal when the shelving assembly is in the second orientation.

Each shelving assembly may comprise a substantially planar shelf, and a first locking formation secured to the shelf. The first locking formation may be engagable with a formation on at least the first support structure to retain the shelving assembly in the first orientation. The first locking formation may also be disengagable from the formation on the first support structure to allow for movement of the shelving assembly between the first and second orientations.

Preferably, the first support structure comprises a vertically extending member, and a plurality of respective second locking formations at spaced locations on the vertically extending member. The first locking formation of each respective shelving assembly may be releasably engagable with a respective second locking formation to retain the respective shelving assembly in the first orientation.

Each shelving assembly may comprise at least one mounting component secured to the shelf and extending from an end thereof, wherein the first locking formation is on an outer surface of the mounting component. The first support structure may comprise a vertically extending member, and a plurality of channel-shaped members securable at spaced locations to the vertically extending member, each channel-shaped member having an internal surface defining the second locking formation and each channel-shaped member having an open upper side into which the mounting component of a respective shelving assembly is insertable to secure the shelving assembly to the first support structure.

The first and second locking formations are preferably substantially rectangular.

The shelving assembly may further comprise a third vertically extending support structure which is horizontally spaced from the second support structure, and a second set of shelving assemblies mounted above one another between the second support structure and to the third support structure. Each shelving assembly of the second set may have at least one major surface and may be movable between a first orientation wherein the major surface is substantially horizontal, and a second orientation wherein the major surface is substantially vertical.

The shelving system may further comprise a first strip member, a second strip member, and a first, second, third and fourth link. The first strip member may be horizontally securable to a wall. The first link may have one end which is releasably securable to the first support structure and another, opposing end secured to the first strip member. The second link may have one end which is releasably securable to the second support structure and another, opposing end secured to the first strip member. The second strip member may also be horizontally securable to the wall. The third link may have one end which is releasably securable to the second support structure and another, opposing end secured to the second strip member. The fourth link may have one end which is releasably securable to the third support structure and another, opposing end secured to the second strip member.

According to another aspect of the invention, a shelving system is provided comprising at least a first vertically extending member, at least one channel-shaped member, a planer shelf, and a mounting component. The channel-shaped member is secured to the first vertically extending member and has an upper, open side with an inner surface defining a first locking formation. The mounting component is secured to the shelf and extends from an end of the shelf. The mounting component is insertable through the upper, open side into the channel-shaped member both when the shelf is in a first orientation wherein a major surface thereof is substantially horizontal and when the shelf is in a second orientation wherein the major surface is substantially vertical. The first and second locking formations may engage with one another to prevent movement of the shelf out of the first orientation at least when the shelf is in the first orientation.

The first and second locking formations may engage with one another to prevent rotation of the shelf when the shelf is in the second orientation.

At least the second locking formation may be square.

BRIEF DESCRIPTION OF THE DRAWINGS

The invention is further described by way of a example with reference to the accompanying drawings wherein.

DESCRIPTION OF PREFERRED EMBODIMENT

Figure 1:
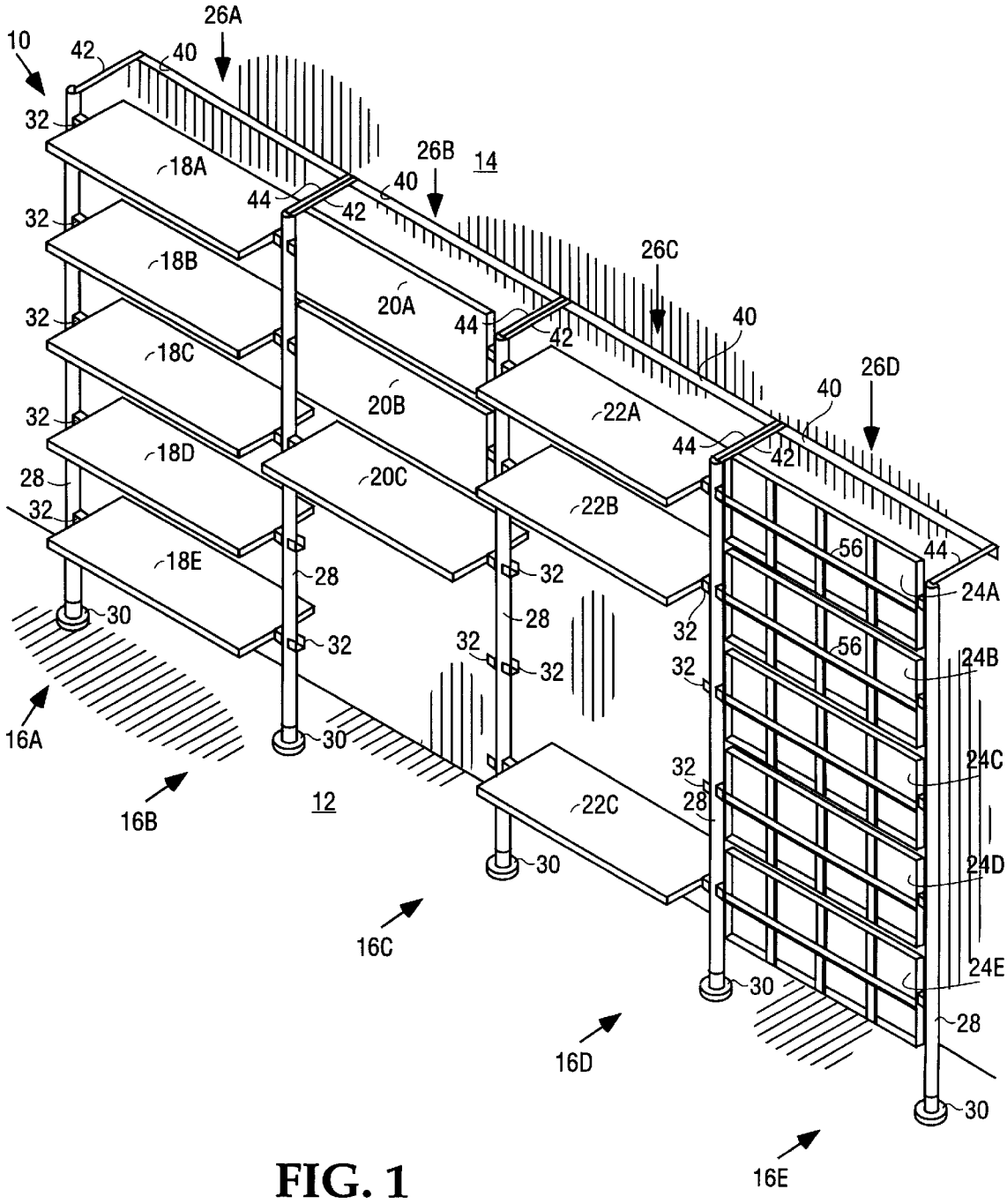
FIG. 1 is a perspective view of a shelving assembly according to an embodiment of the invention.

FIG. 1 of the accompanying drawings illustrates a shelving system 10, according to an embodiment of the invention, which is installed on a floor 12 and against a wall 14 extending upwardly from the floor 12. The shelving system 10 includes a first through a fifth vertically extending support structure 16A–16E, a first set of shelving assemblies 18A–18E, a second set of shelving assemblies 20A–20C, a third set of shelving assemblies 22A–22C, a fourth of set of shelving assemblies 24A–24E, and a first through a fourth bracket assembly 26A–26D.

The support structures 16 are located in line and are horizontally spaced from one another, i.e. the second support structure 16B is horizontally spaced from the first support structure 16A, the third support structure 16C is then horizontally spaced from the second support structure 16B, and so on. The shelving assemblies 18A–18E of the first set are mounted directly above one another between the first and second support structures 16A and 16B, the second shelving assemblies 20A–20C of the second set are mounted directly above one another between the second support structure 16B and the third support structured 16C, and so on.

Each vertically extending support structure 16 includes a vertically extending member 28, a foot component 30 which is secured to a lower end of the vertically extending member 28 and a plurality of channel-shaped members 32 secured, or at least securable, at spaced locations directly above one another and on opposing sides of the vertically extending member 28.

Figure 2:
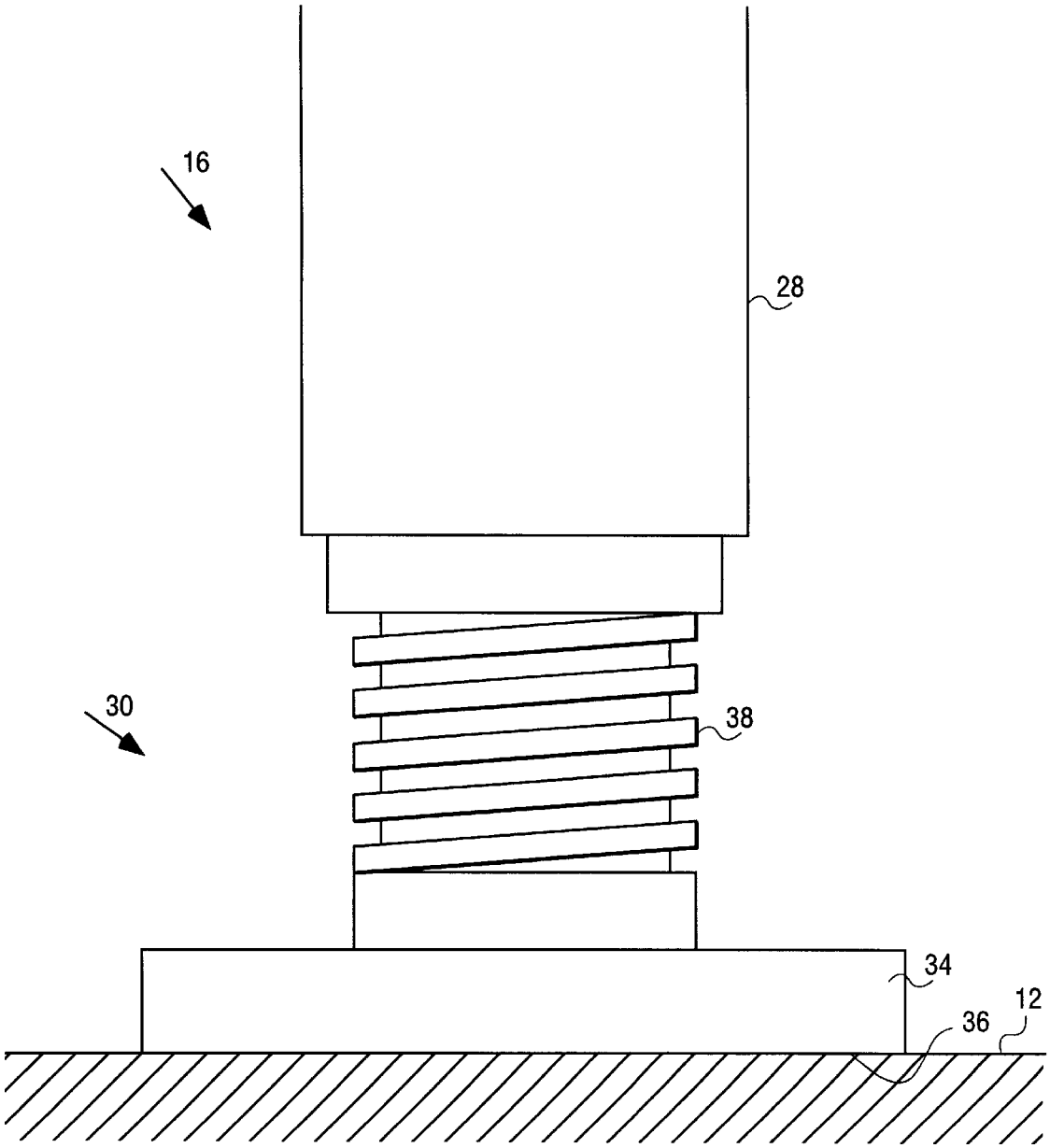
FIG. 2 is a side view of a lower end of a support structure forming part of the shelving assembly of FIG. 1.

FIG. 2 illustrates in enlarged detail a lower end of one of the support structures 16. The foot component 30 comprises a disk-shaped member 34 having a lower surface 36 which engages the floor 12, and a threaded shank 38 secured to the disk-shaped member 34 on a side thereof opposing the lower surface 36. Threads of the shank 38 are engaged with complementary threads (not shown) within a lower end of the vertically extending member 28. Rotation of the foot component 30 results in movement of the threaded shank 38 into or out of the vertically extending member 28 an adjustment of the lower surface 36 towards and away from the vertically extending member 28.

Referring again to FIG. 1, each bracket assembly 26 comprises a strip member 40 and first and second links 42 and 44 respectively.

The strip member 40 is horizontally secured to the wall 14 by means of fasteners such as bolts or the like. Each link 42 or 44 has one end secured to a respective end of the strip member 40. The links 42 and 44 extend parallel to one another from the strip member 40 and the wall 14. Another, opposing end of each link 42 or 44 is secured to an upper end of a respective vertically extending member 28 of a respective support structure 16. For example, the first link 42 of the first bracket assembly 26A is secured to the first support structure 16A and the second link 44 of the first bracket assembly 26A is secured to the second support structure 16B. The first link 42 of the second bracket assembly 26B is also secured to the second support structure 16B and the second link 44 of the second bracket assembly 26B is secured to the third support structure 16C. The third, fourth and fifth support structures 16C–16E are secured to the third and fourth bracket assemblies 26C and 26D in a similar manner.

Figure 3:
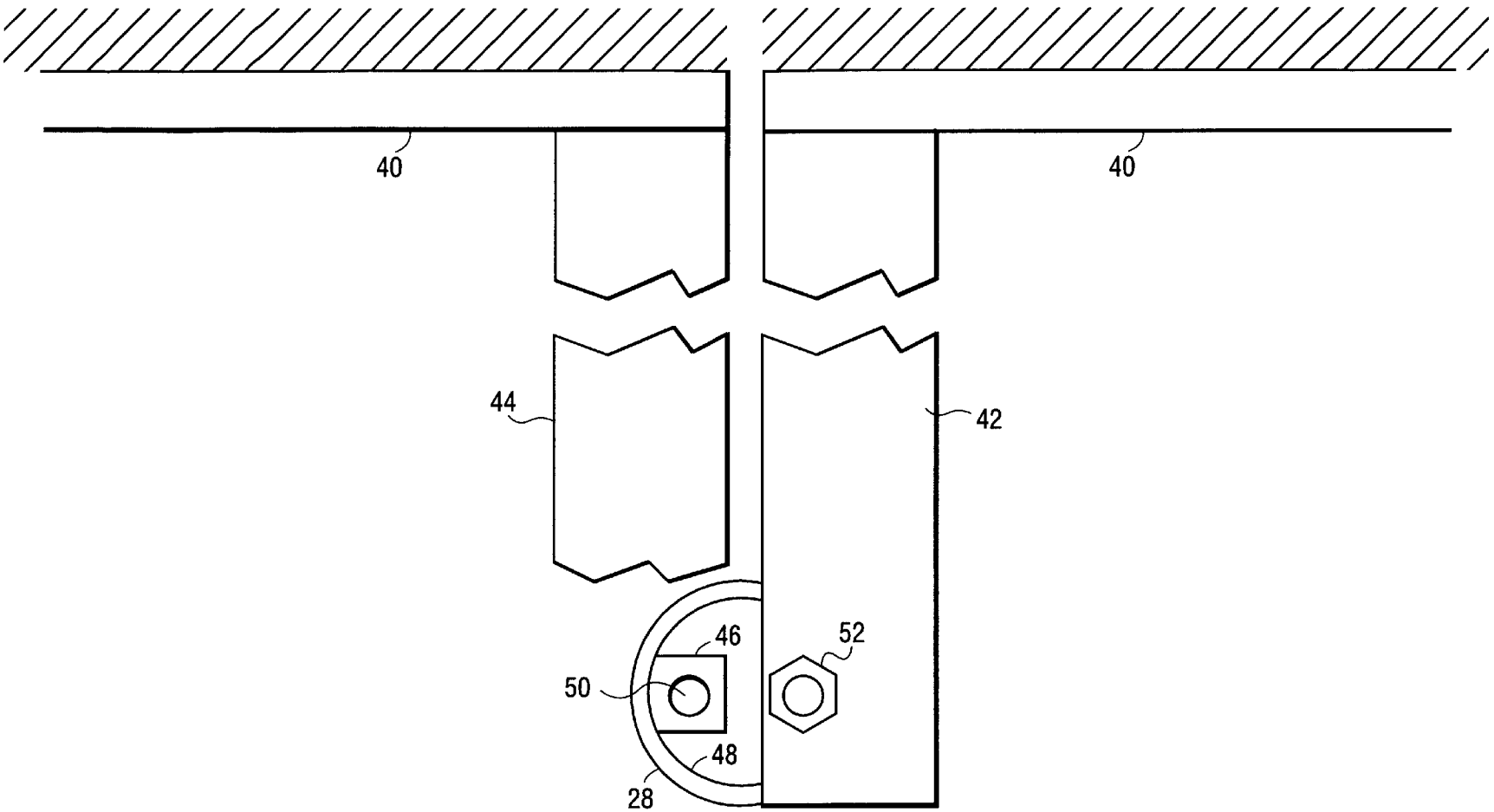
FIG. 3 is a plan view of portion of bracket assemblies and a vertically extending member forming part of the shelving system of FIG. 1.

FIG. 3 illustrates how the vertically extending members 28 and the links 42 and 44 are secured to one another. The vertically extending member 28 is made of round tubing. Two washers 46 (only one shown) are welded to an inner surface 48 of the vertically extending member 28 and on opposing sides thereof. Each washer 46 has a threaded opening 50 therein. Each link 42 or 44 extends partially over the vertically extending member 28 and has an opening (not shown) therein which is aligned with a respective threaded opening 50 of a respective washer 46. A fastener such as a bolt 52 is inserted through the opening in the link 42 or 44 and threadably engages the threaded opening 50 of the respective washer 46. The respective link 42 or 44 is so releasably secured to a respective vertically extending member 28.

Figure 4:
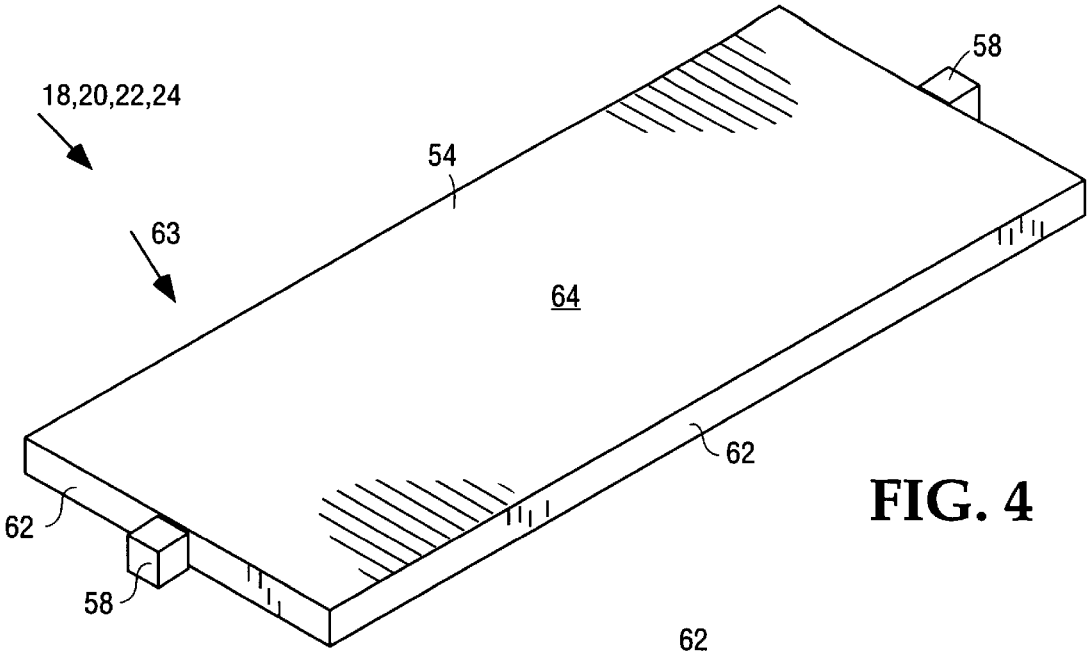
FIG. 4 is a perspective view of a shelving assembly forming part of the shelving system of FIG. 1.
Figure 5:
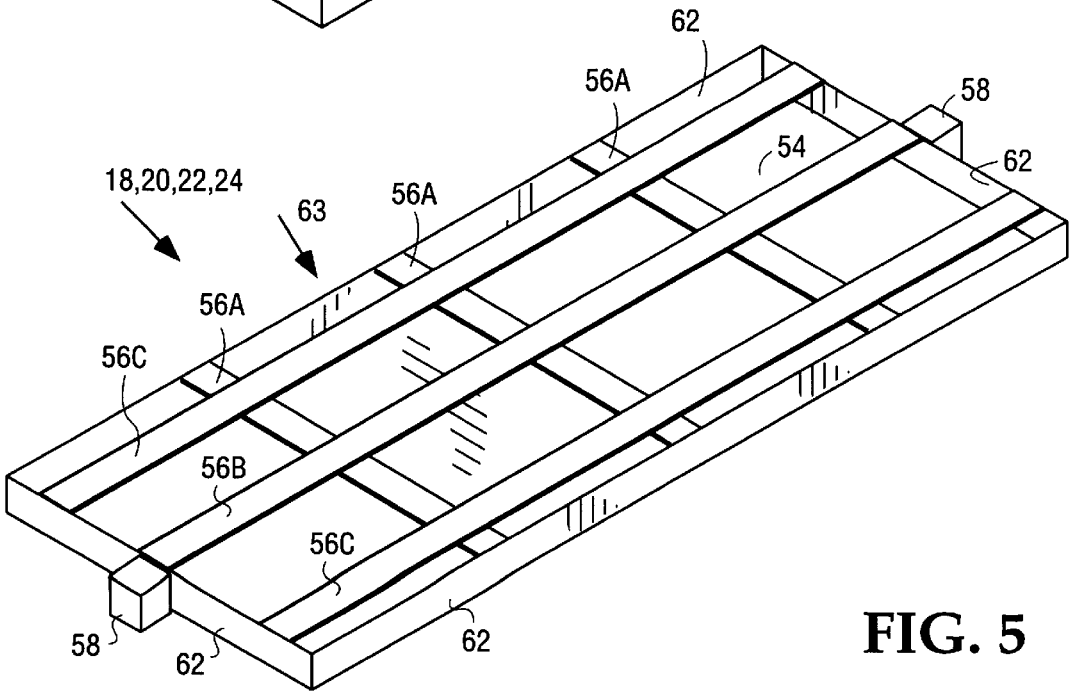
FIG. 5 is a perspective view of the shelving assembly from an opposing side than shown in FIG. 4.

FIGS. 4 and 5 illustrate one of the shelving assemblies 18, 20, 22 or 24 respectively from one side and from an opposing side thereof. The shelving assembly 18, 20, 22 or 24 includes a sheet metal member 54, a number of rails 56, and two mounting components 58.

The sheet metal member 54 has edge regions 62 which are bent through 90° to provide a substantially planar shelf having a recessed shape. The sheet metal member 54 has an elongate shape with a central region thereof forming a major surface 64 of the planar shelf 63.

Some of the rails 56A are mounted between long edges of the planar shelf 63. One of the rails 56B is mounted between short edges of the planar shelf 63, substantially centrally on the short edges. Additional rails 56C are provided between the rail 56B and the long edges of the shelf 63. Each rail has a central section which is spaced from the sheet metal member 54.

The mounting components 58 are secured to the edge regions 62 on opposing short edges of the sheet metal member 54. Each mounting component 58 has a square shape when viewed along a length of the shelving assembly 18, 20, 22 or 24.

FIGS. 6, 7, 8 and 9 now illustrate how the shelving assemblies 18, 20, 22, of 24 are mounted to the support structures 16A–16E.

Figure 6:
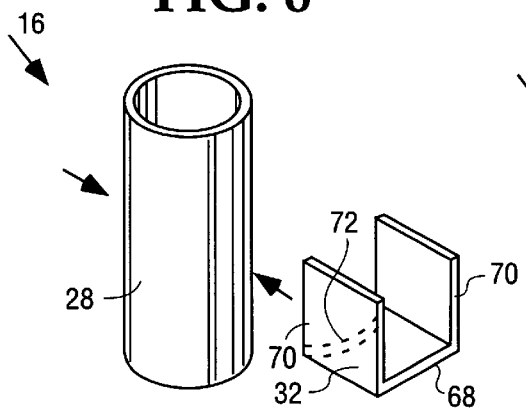
FIG. 6 is a perspective view of the vertically extending member and a channel-shaped member before being secured to the vertically extending member.

FIG. 6 illustrates a portion of one of the vertically extending members 28 and one of the channel-shaped members 32.

The channel-shaped member 32 has a rectangular shape defined by a horizontal base portion 68 and two vertical side walls 70 extending upwardly from edges of the base portion 68. A circular shape 72 is stamped out of another edge of the base portion 68. An inner surface of the channel-shaped member 32 has a substantially rectangular shape.

Figure 7:
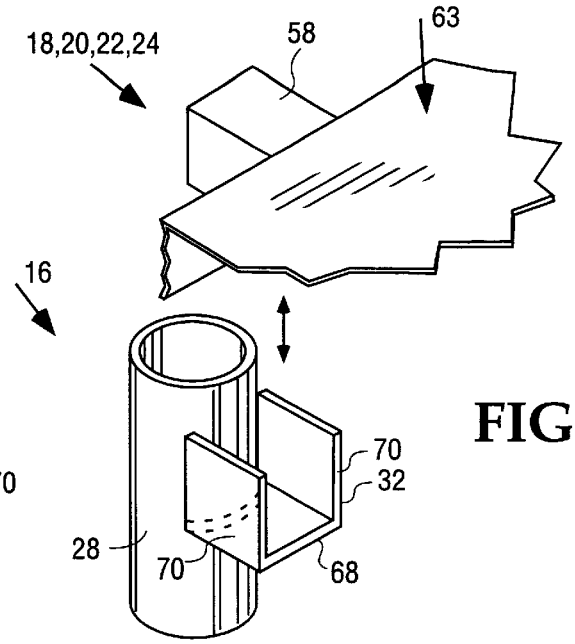
FIG. 7 is a perspective view of the vertically extending member with the channel-shaped member secured thereto, and a portion of a shelving assembly as in FIGS. 4 and 5.

FIG. 7 illustrates the channel-shaped member 32 which is assembled with the vertically extending member 28, and one end of one of the shelving assemblies 18, 20, 22 or 24. The channel-shaped member 32 is secured to the vertically extending member 28 by engaging the circular shape 72 of the base portion 68 and the edges of the side walls 70 with the vertically extending member 28, and welding the channel-shaped member 32 to the vertically extending member 28.

Figure 8:
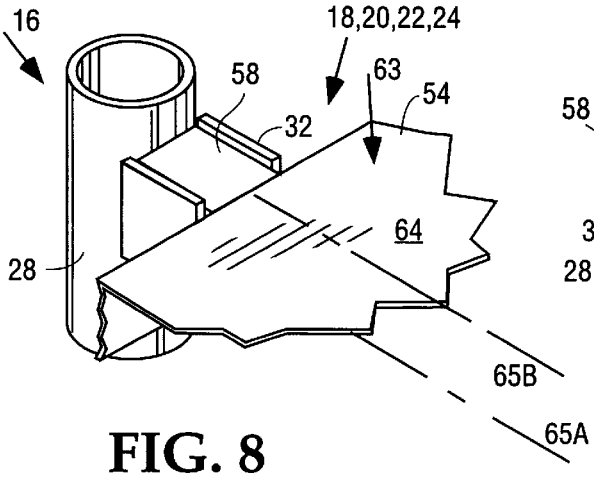
FIG. 8 is a perspective view similar to FIG. 7 after the shelving assembly is secured to the vertically extending member.

FIG. 8 illustrates the components shown in FIG. 7 after the shelving assembly 18, 20, 22 or 24 is mounted in a first orientation to the vertically extending member 28. The mounting component 58, extending from the sheet metal member 54, is inserted through an upper, open side of the channel-shaped member 32 and rests within the channel-shaped member 32. The substantially square profile of the mounting component 58 engages, or "locks" within the rectangular inner surface of the channel-shaped member 32 so as to prevent rotation of the shelving assembly 18, 20, 22 or 24 relative to the vertically extending member 28 out of the first orientation shown in FIG. 8. The inner surface of the channel-shaped member 32 and the outer surface of the mounting component 58 are thus interengaging locking formations preventing rotation of the shelving assembly 18, 20, 22 or 24. As shown in FIG. 8, the major surface 64 is located substantially horizontally.

Figure 9:
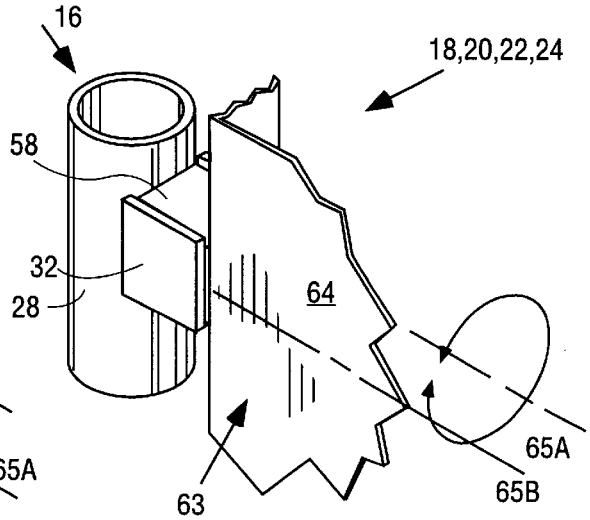
FIG. 9 a view similar to FIG. 8 after the shelving assembly is moved or rotated through 90°.

Because the upper side of the channel-shaped member 32 is open, there is allowed for lifting of the mounting component 58 out of the channelshaped member 32 (see FIG. 7). The shelving assembly 18, 20, 22 or 24 may then be rotated through 90° into a second orientation and then be lowered so that the mounting component 58 is again inserted into the channel-shaped member 32, as illustrated in FIG. 9. The shelving assembly 18, 20, 22 or 24 rotates between the respective orientation about an axis 65A which is located directly below a center line 65B of the planar shelf 63 when the shelving assembly 18, 20, 22, or 24 is in the first orientation shown in FIG. 8. The rail 56B remains horizontal throughout rotation of the shelving assembly 18, 20, 22, or 24. The major surface 64 is then located substantially vertically and rotation of the shelving assembly 18, 20, 22 or 24 is again prevented by engagement of the square shape of the mounting component 58 within the rectangular inner surface of the channel-shaped member 32.

Although FIGS. 8 and 9 illustrate rotation of the shelving assembly 18, 20, 22 or 24 in an anti-clockwise direction, it should be understood that the shelving assembly may alternatively be rotated in a clockwise direction so that the rails 56 face forward, instead of the major surface 64.

Although only one end of a shelving assembly 18, 20, 22 or 24 is shown secured to one support structure 16, it should be understood that an opposing end of the shelving assembly 18, 20, 22 or 24 is secured to another support structure (not shown) in a similar manner.

Referring again to FIG. 1, the shelving system 10 is assembled by first mounting the bracket assemblies 26A–26D at required locations horizontally against the wall 14. The support structures 16A–16E are then positioned onto the floor 12 at required locations. The foot components 30 are adjusted as hereinbefore described with reference to FIG. 2 until the vertically extending members 28 contact the links 42 or 44, whereafter the links 42 and 44 are secured to the support structures 16A–16E as hereinbefore described with reference to FIG. 3. The channel-shaped members 32 may be added to or removed from the vertically extending members 28 as required. For example, channel-shaped members 32 are only required on one side of the vertically extending member 28 of the first support structure 16A.

The shelving assemblies 18, 20, 22 and 24 are then mounted between the support structures 16A–16E as required. As discussed with reference to FIGS. 8 and 9, some of the shelving assemblies, such as the shelving assemblies 18A–18E, 20C and 20A–20C may be located with the major surfaces 64 thereof substantially horizontally so that objects may be located thereon. Objects such as clothing hangers may be suspended from the rails 56 of the shelving assemblies which are located so that major surfaces 64 thereof are substantially horizontal. In order to provide more space for larger hanging objects, certain of the shelving assemblies may be easily removed—see for example below the shelving assemblies 20C and 22B.

Other shelving assemblies, such as the shelving assemblies 20A and 20B, may be located in orientations wherein the major surfaces thereof are substantially vertical. The vertical major surfaces may be used, for example, for displaying sales information and generally provide for an overall display which is more interesting.

Yet other shelving assemblies, such as the shelving assemblies 20A–20E, may be located in orientations wherein the rails 56 are on a side of the sheet metal member 54 opposing the wall 14. Objects such as baskets may be hooked unto the rails 56. The rails 56 may also be used to suspend clothing hangers or other objects therefrom.

While certain exemplary embodiments have been described and shown in the accompanying drawings, it is to be understood that such embodiments are merely illustrative and not restrictive of the current invention, and that this invention is not restricted to the specific constructions and arrangements shown and described, since modifications may occur to those ordinarily skilled in the art.

For example, it may be possible for a shelving system to have shelving assemblies which are rotatably mounted to vertically extending support structures. Additional locking formations may then be provided on the shelving assemblies which would releasably engage with one or more of the support structures to prevent rotation of the shelving assemblies. Locking formations may, additionally or alternatively, be provided on one or more of the support structures to prevent rotation of the shelving assemblies.

Furthermore, although the channel-shaped members serve multiple functions, including mounting of the shelving assemblies, and locking the shelving assemblies to prevent rotation thereof, it should be understood that channel-shaped members are also contemplated which may serve only to mount shelving assemblies to one or more support structures.

Other modifications are also possible without departing from the scope and spirit of the invention.

What is claimed:

1. A shelving system comprising:

at least first and second vertically extending support structures which are horizontally spaced from one another;

a wall securable member couplable to the first and second vertically extending support structures; and a first set of shelving assemblies mounted above one another between the support structures, each shelving assembly having at least one major surface and being locatable respectively in a first orientation wherein the major surface remains substantially horizontal, and a second orientation wherein the major surface is substantially vertical;

each of said shelving assemblies comprising a substantially planar shelf with the major surface located thereon and a rail coupled to said shelf and spanning a length of said shelf, wherein said rail does not contact said major surface.

2. The shelving system of claim 1 wherein the shelving assembly rotates between the first and second orientations about an axis which is substantially located below a center line of the major surface when the shelving assembly is in the first orientation.

3. The shelving system of claim 1 wherein the shelving assembly comprises:

two mounting components secured to the planar shelf and extending from opposing ends of the shelf, each being mounted to a respective support structure while allowing for movement of the shelving assembly between the first and second orientations.

4. The shelving system of claim 3 wherein at least the first support structure comprises:

a vertically extending member; and a plurality of channel-shaped members securable at spaced locations to the vertically extending member, wherein at least one of the mounting components of each shelf is insertable through an upper, open side of a respective channel-shaped member and rests within the channel-shaped member.

5. The shelving system of claim 1 wherein one of the shelving assemblies is movable between the first and second orientations thereof while another of the shelving assemblies remains stationary.

6. The shelving system of claim 1 comprising a first link having one end which is securable to the first support structure and another, opposing end which is secured to the wall securable member.

7. The shelving system of claim 6 comprising a second link having one end which is securable to the second support structure and another, opposing end which is secured to the wall securable member.

8. The shelving system of claim 6 wherein each support structure comprises:

a vertically extending member; and a foot component which is secured to a lower end of the vertically extending member.

9. The shelving system of claim 8 wherein the foot component has a lower, floor engaging surface which is adjustable towards or away from the vertically extending member.

10. The shelving system of claim 9 wherein the foot component is rotatable and rotation of the foot component results in adjustment of the lower surface towards or away from the vertically extending member.

11. The shelving system of claim 1 wherein the rail is substantially horizontal when the shelving assembly is in the second orientation.

12. The shelving system of claim 1 wherein each shelving assembly comprises:

a first locking formation, secured to the planar shelf, which is engageable with a second locking formation on at least the first support structure to retain the shelving assembly in the first orientation, the first locking formation being disengageable from the second locking formation to allow for movement of the shelving assembly between the first and second orientations.

13. The shelving system of claim 12 wherein the first support structure comprises:

a vertically extending member; and a plurality of respective second locking formations at spaced locations on the vertically extending member, wherein the first locking formation of each respective shelving assembly is releasably engageable with a respective second locking formation to retain the respective shelving assembly in the first orientation.

14. The shelving system of claim 13 wherein each shelving assembly comprises:

at least one mounting component, secured to the shelf and extending from an end thereof, wherein the first locking formation is on an outer surface of the mounting component, and the first support structure further comprises:

a plurality of channel-shaped members securable at spaced locations to the vertically extending member, each channel-shaped member having an internal surface defining a respective one of the second locking formations and each channel-shaped member having an open upper side into which a mounting component of a respective shelving assembly is insertable to secure the shelving assembly to the first support structure.

15. The shelving system of claim 14 wherein the first and second locking formations are substantially rectangular.

16. The shelving system of claim 1 comprising:

a third vertically extending support structure which is horizontally spaced from the second support structure; and a second set of shelving assemblies mounted above one another between the second support structure and the third support structure, each shelving assembly of the second set having at least one major surface and being movable between a first orientation wherein the major surface is substantially horizontal, and a second orientation wherein the major surface is substantially vertical.

17. The shelving system of claim 16 comprising:

a first strip member which is horizontally securable to a wall;

a first link having one end which is releasable securable to the first support structure and another, opposing end secured to the first strip member;

a second link having one end which is releasably securable to the second support structure and another, opposing end secured to the first strip member;

a second strip member which is horizontally securable to the wall;

a third link having one end which is releasably securable to the second support structure and another, opposing end secured to the second strip member; and a fourth link having one end which is releasably securable to the third support structure and another, opposing end secured to the second strip member.

18. A shelving system comprising:

at least a first vertically extending member;

a wall securable member couplable to the first vertically extending member;

at least one channel-shaped member secured to the vertically extending member, the channel-shaped member having an upper, open side and an inner surface defining a first locking formation;

a planar shelf with a major surface located thereon and a rail coupled to said shelf and spanning a length of said shelf, wherein said rail does not contact said major surface; and a mounting component secured to the shelf and extending from an end of the shelf, the mounting component being insertable through the upper, open side into the channel-shaped member both when the shelf is in a first orientation wherein a major surface thereof is substantially horizontal and when the shelf is in a second orientation wherein the major surface is substantially vertical, the mounting component having a second locking formation on an outer surface of the mounting component, the first and second locking formations engaging with one another to prevent movement of the shelf out of the first orientation at least when the shelf is in the first orientation.

19. The shelving system of claim 18 wherein the first and second locking formations engage with one another to prevent rotation of the shelf when the shelf is in the second orientation.

20. The shelving system of claim 19 wherein the second locking formation is square.

* * * * *

UNITED STATES PATENT AND TRADEMARK OFFICE

CERTIFICATE OF CORRECTION

PATENT NO. : 6,123,033
DATED : September 26, 2000
INVENTOR(S) : Polley et al.

It is certified that error appears in the above-identified patent and that said Letters Patent is hereby corrected as shown below:

Item [75], Inventors, replace inventor name "Todd W. Jacobson" and insert -- Todd W. Jacobsen --.
Item [56], U.S. Patent Document 3,151,576, delete date "10/1964" and insert -- 12/1964 --.

Signed and Sealed this

Fourth Day of December, 2001

*Attest:*

Nicholas P. Godici

*Attesting Officer*

NICHOLAS P. GODICI
*Acting Director of the United States Patent and Trademark Office*